US006854387B2

(12) United States Patent
Lee et al.

(10) Patent No.: US 6,854,387 B2
(45) Date of Patent: Feb. 15, 2005

(54) METHOD OF COLOR PRINTING PACKAGING CONTAINER STOCK

(75) Inventors: David L. Lee, Tacoma, WA (US); Amar N. Neogi, Kenmore, WA (US)

(73) Assignee: Weyerhaeuser Company, Federal Way, WA (US)

( * ) Notice: Subject to any disclaimer, the term of this patent is extended or adjusted under 35 U.S.C. 154(b) by 55 days.

(21) Appl. No.: 10/286,240

(22) Filed: Oct. 31, 2002

(65) Prior Publication Data

US 2003/0051624 A1 Mar. 20, 2003

Related U.S. Application Data

(62) Division of application No. 09/826,473, filed on Apr. 4, 2001.

(51) Int. Cl.[7] ..... B41M 1/14

(52) U.S. Cl. ..... 101/211; 101/483; 53/411; 428/195

(58) Field of Search ..... 101/211, 483; 53/411, 131.2; 428/34.2, 195

(56) References Cited

U.S. PATENT DOCUMENTS

| | | | | | |
|---|---|---|---|---|---|
| 3,926,117 | A | * | 12/1975 | Milligan | 101/211 |
| 4,048,736 | A | * | 9/1977 | Castleman et al. | 428/500 |
| 4,554,241 | A | | 11/1985 | Edwards | 430/301 |
| 4,898,752 | A | * | 2/1990 | Cavagna et al. | 101/483 |
| 4,998,962 | A | | 3/1991 | Edwards | 101/211 |
| 5,037,682 | A | | 8/1991 | Gerstner et al. | 428/34.2 |
| 5,074,206 | A | | 12/1991 | Edwards | 101/211 |
| 5,140,339 | A | * | 8/1992 | Higuma et al. | 347/103 |
| 5,193,456 | A | | 3/1993 | Wolfe et al. | 101/40 |
| 5,205,211 | A | | 4/1993 | Edwards | 101/171 |
| 5,333,549 | A | * | 8/1994 | Feldman | 101/483 |
| 5,429,047 | A | * | 7/1995 | Marmolejo et al. | 101/211 |
| 5,493,321 | A | * | 2/1996 | Zwadlo | 347/131 |
| 5,542,529 | A | | 8/1996 | Hein et al. | 206/245 |
| 5,733,634 | A | * | 3/1998 | Karel | 428/195 |
| 5,933,578 | A | * | 8/1999 | Van de Capelle et al. | 101/23 |
| 5,982,924 | A | | 11/1999 | Power et al. | 382/162 |
| 6,190,735 | B1 | * | 2/2001 | Radwanski et al. | 427/348 |
| 6,190,744 | B1 | | 2/2001 | Akao et al. | 428/34.2 |
| 6,207,242 | B1 | | 3/2001 | Hoffman | 428/34.2 |
| 6,267,052 | B1 | * | 7/2001 | Hill et al. | 101/211 |
| 6,477,948 | B1 | * | 11/2002 | Nissing et al. | 101/211 |

OTHER PUBLICATIONS

Power, J. L., B. S. West, E. J. Stolnitz, and D. H. Salesin. Reproducing color images as duotones. In *Proceedings of SIGGRAPH 96*, pp 237–248 (1996).

Stolnitz, E. J., V. Ostromoukhov, and David H. Salesin. Reproducing color images using custom inks. In *Proceedings of SIGGRAPH 98*, pp 267–274 (1998).

Southworth, M. Printing color images with two non–process color inks, toners or paints. Technical Association of the Graphic Arts, Proceedings, vol. 2, pp 856–861 (1995).

Southworth, M. Two–color separations. *Ink on Paper: Imaging Technologies and Business Strategies*, pp 1–4, Sep. 1996.

Brochure, This is 2 color printing. Markolor Imaging Technologies Inc., Livonia, NY (1993).

* cited by examiner

*Primary Examiner*—Eugene H. Eickholt

(57) ABSTRACT

A method of color printing on packaging containers using transparent colors is described. The method is limited to the use of no more than two of the primary process colors. For many images primary process colors are not needed at all. Preferably, only two transparent inks will be used. In some cases an opaque ink may be applied first as a masking image underlying a part or all of the transparent ink overprint. In other cases the opaque ink may be applied last as a masking print over part of the image. The method can be used on any substrate color but it is particularly useful on dyed papers or unbleached kraft brownboard. While color reproduction is not totally accurate, nor is this expected in a colorimetric sense, surprisingly attractive and realistic images generally faithful to the original are attainable.

24 Claims, 4 Drawing Sheets

Laydown order: yellow, magenta, cyan

METHOD OF COLOR PRINTING PACKAGING CONTAINER STOCK

This application is a division of application Ser. No. 09/826,473, filed Apr. 4, 2001.

The present invention is a method of color printing packaging container stock using multiple colors, at least two of which are transparent inks. The printed product also forms a part of the invention.

BACKGROUND OF THE INVENTION

The predominant material used for shipping containers worldwide is corrugated containerboard. Smaller packaging may be formed from a heavy paperboard that may be formed from bleached stock or, more commonly, from bleached or recycled fiber with a white or colored layer laid on one or both surfaces.

Corrugated containerboard is typically formed from two outer or liner plies adhesively bonded to an inner corrugated ply. The overwhelming majority of these containers use an unbleached kraft process fiber for the liner plies. A smaller number are made with a white or mottled white secondary surface on the outer ply or a fully bleached outer ply. Some corrugated containers are also formed by laminating a pre-printed white paper label over some or all of the outer ply. The so-called white or mottled white liner is made by laying down a thin surface of bleached fiber over the unbleached fiber during the papermaking process.

Because of the brown color of the unbleached kraft board, it does not provide a background amenable to attractive color printing. What printing is done on this so-called brownboard has almost universally used opaque inks, black being the most common ink. Opaque inks are also normally used on white or mottled white container-board surfaces although, very infrequently, three color overprinted CMY or four color CMYK (cyan, magenta, yellow, black) transparent inks have been applied using ink jet or other printing technology, such as flexography. These colors are known as "process primaries" and form the basis for most color printing using transparent inks. Shipping container stock is usually printed after the corrugated board is formed. However, the outer liner may also be preprinted before lamination to the single faced board at the double backer station of the corrugating machine.

Colors formed by opaque inks are generally limited to those applied whereas transparent inks laid over top of one another on a white or other color substrate can generate a wide range of new colors. Everybody who has used blue and yellow marker pens for highlighting portions of documents is aware that they form green if overlapped. The presumed reason that transparent inks have not been used on brownboard is that the background color unavoidably changes and degrades the perceived applied color after printing. Color images have been further limited because with opaque inks, depending on the degree of opacity, the uppermost color printed will either significantly or completely obscure anything underlying. Conventional halftone color imaging using opaque inks is used routinely on white stock but this technology is not used on an unbleached substrate.

The present invention goes against the conventional printing wisdom and teaches a method that will produce attractive and reasonably accurate color images on a variety of packaging container stock substrates using transparent inks.

SUMMARY OF THE INVENTION

The present invention is directed to a method of printing packaging container stock and to the products of the method.

The term "packaging container" should be read to include conventional corrugated shipping containers or containers formed from paperboard. The inventors have found that attractive color reproduction can be achieved on unbleached and other substrate materials using overprinted transparent inks, or overprinted transparent inks in combination with underlying or overlying opaque inks that provide a masking pattern. This is entirely contrary to the conventional wisdom in the art that dictates that only opaque inks must be used for printing on shipping containers that do not have white surfaces.

The invention may use two or more transparent inks. However, it differs from conventional practice in that no more than two may be standard process primary cyan/magenta/yellow (CMY) inks. Further, it is not required that any of the transparent inks need be primary process colors. More usually, if process primary inks are used at all, only one will be needed. In a preferred practice of the method only two transparent inks need be used. These may be printed directly on the substrate; e.g., corrugated linerboard, which is either unbleached, white or mottled white, bleached, or another color; e.g., by addition of dyes during the papermaking process. Alternatively, one or more opaque inks may be first printed to provide a masking surface or pattern and then the transparent inks may be overprinted over part or all of the masked area. Opaque inks may also be overprinted on portions of the transparent inks to provide "spot" areas of opaque colors. The invention is clearly distinguished from the rare past instances when transparent inks might have been used for printing corrugated containers in which either all of the primary process colors (CMY) were required or in which all the primaries were used with black (CMYK).

"Opaque ink" is a standard term used in the industry and generally refers to the ability of an ink film to absorb and scatter light without transmission. While there may be some slight amount of show through with certain inks, the degree of transmission should meet specifications outlined in publications such as ISO 2846-1 through ISO 2846-5, Graphic Technology-Colour and transparency of printing ink sets for four-colour printing, Parts 1–5.

"Transparent ink" is also a standard industry term that refers to the ability of an ink film to absorb and transmit light without scattering. For example, see Draft ISO 2846-5, Graphic Technology-Colour and transparency of printing ink sets for four-colour printing, Part 5: Flexographic Printing. A process cyan ink is considered transparent if the slope of the regression curve that relates color error to percentage of press-ready extender used is less than 0.083.

An ink "extender" is the addition of a transparent material (or colorant-free ink) to the ink to reduce the pigment concentration without significantly influencing the rheological properties of the ink. "Color error" is defined as the color (in L*a*b* coordinates) of the overprinted ink on a black surface minus the color of the surface at a given ink extender level applied to press ready ink. Since reflected light is being measured to arrive at color, the degree of ink transmission is implicitly obtained by measuring its degree of opacity.

By "overprinted" is meant that one ink is printed directly on top of and covers part or all of the underlying ink image.

The method of the invention is amenable to all standard technologies presently used for printing packaging containers. These include lithography and flexography. Further, the method is amenable to other ink or toner application techniques such as ink jet printing and xerography, respectively.

Specifically considering corrugated shipping containers, the usual method of printing is to print the combined corrugated medium and liners, so called "double faced board", prior to or after forming shipping container blanks. However, it is fully within the scope of the invention to first print either of the liners before they are combined with the corrugated medium.

Original images to be reproduced are treated by available software programs which can be employed for making color separations.

It is an object of the invention to reproduce color images using overprinted transparent inks.

It is a further object to reproduce color images on corrugated shipping containers using transparent inks wherein no more than two process primary colors are ever used.

It is another object to reproduce color images on corrugated shipping containers using transparent inks with an underlay of opaque ink that constitutes a masking surface.

It is yet an object to reproduce color images on corrugated shipping containers using transparent inks in which the resultant image has a reasonably high degree of color accuracy and/or color acceptance when compared with the original image.

These and many other objects will become readily apparent to those skilled in the art upon reading the following detailed description taken in conjunction with the drawings.

BRIEF DESCRIPTION OF THE DRAWINGS

The file of this patent contains four drawings executed in color. Copies of this patent with color drawings will be provided by the Office upon request and payment of the necessary fee.

DETAILED DESCRIPTION OF THE PREFERRED EMBODIMENTS

Figure 1:
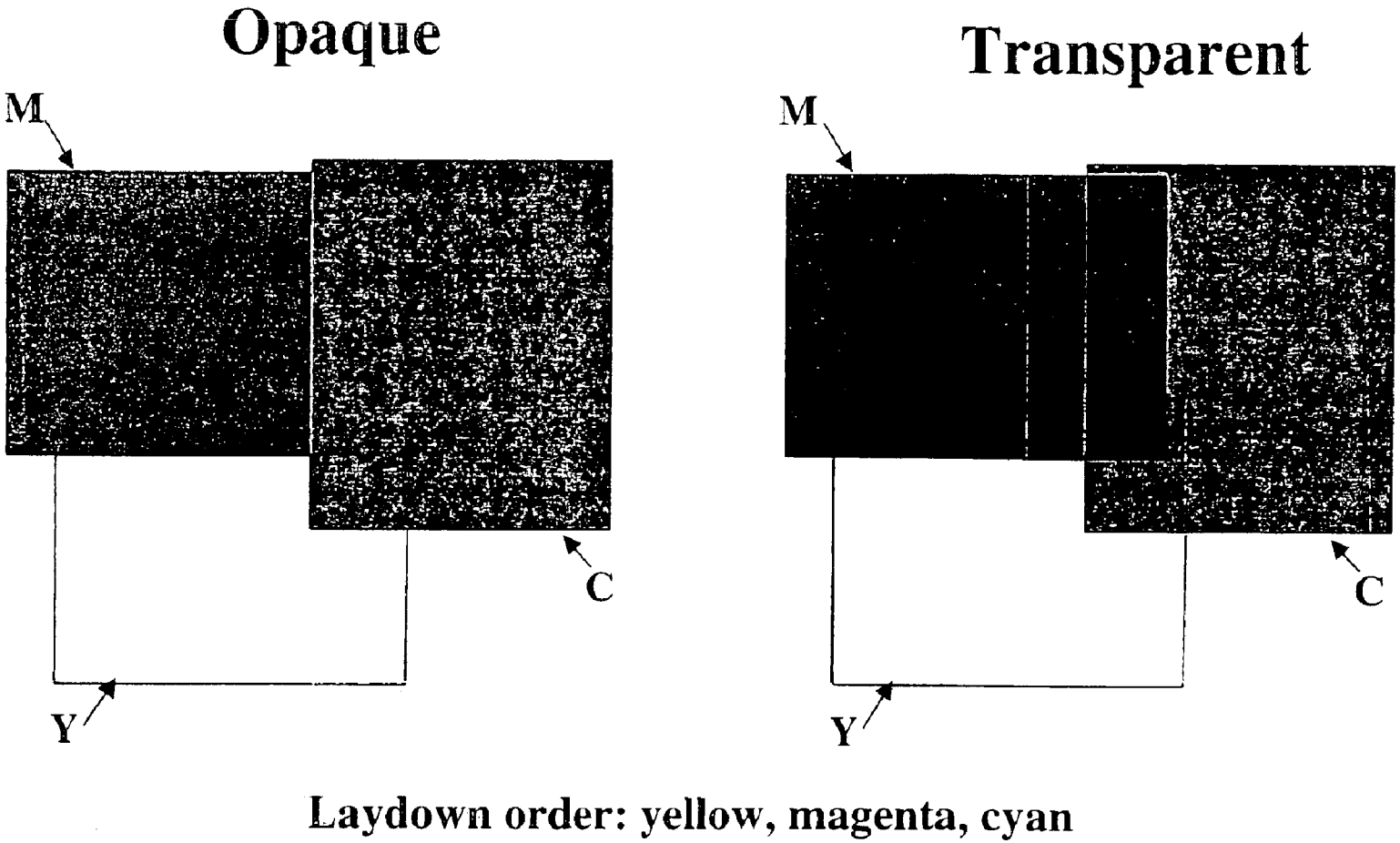
FIG. 1 illustrates three opaque primary process colors and three transparent primary process colors in an overlaid relationship.

Reference may now be made to the drawings for a full understanding of the invention. FIG. 1 shows the three primary process colors laid down in an overlapping relationship using both opaque and transparent inks. In both cases the yellow field was printed first, the magenta field second, and the cyan field last. Using the opaque inks, the magenta completely obscures the yellow where overlaid and the cyan obscures both the yellow and magenta With inks having less than 100% opacity some over-printed colors may be slightly visible. However, the resulting secondary or tertiary colors would be best described as dull, dark, or "muddy". Inks of this type, employed in such a manner, do little to expand the color gamut. With conventional halftone printing methods, they are not the colorants of choice where large color gamuts are desired. The situation is very different with the transparent inks. Magenta overlaid on yellow forms a red image, cyan overlaid on magenta forms a blue image, and cyan over yellow a green image. The use of transparent inks is drawn from basic subtractive color physics. Black, in principle, is formed where the three inks are superimposed. Impurities in some inks may cause formation of a brownish-black, rather than a jet black.

Figure 2:
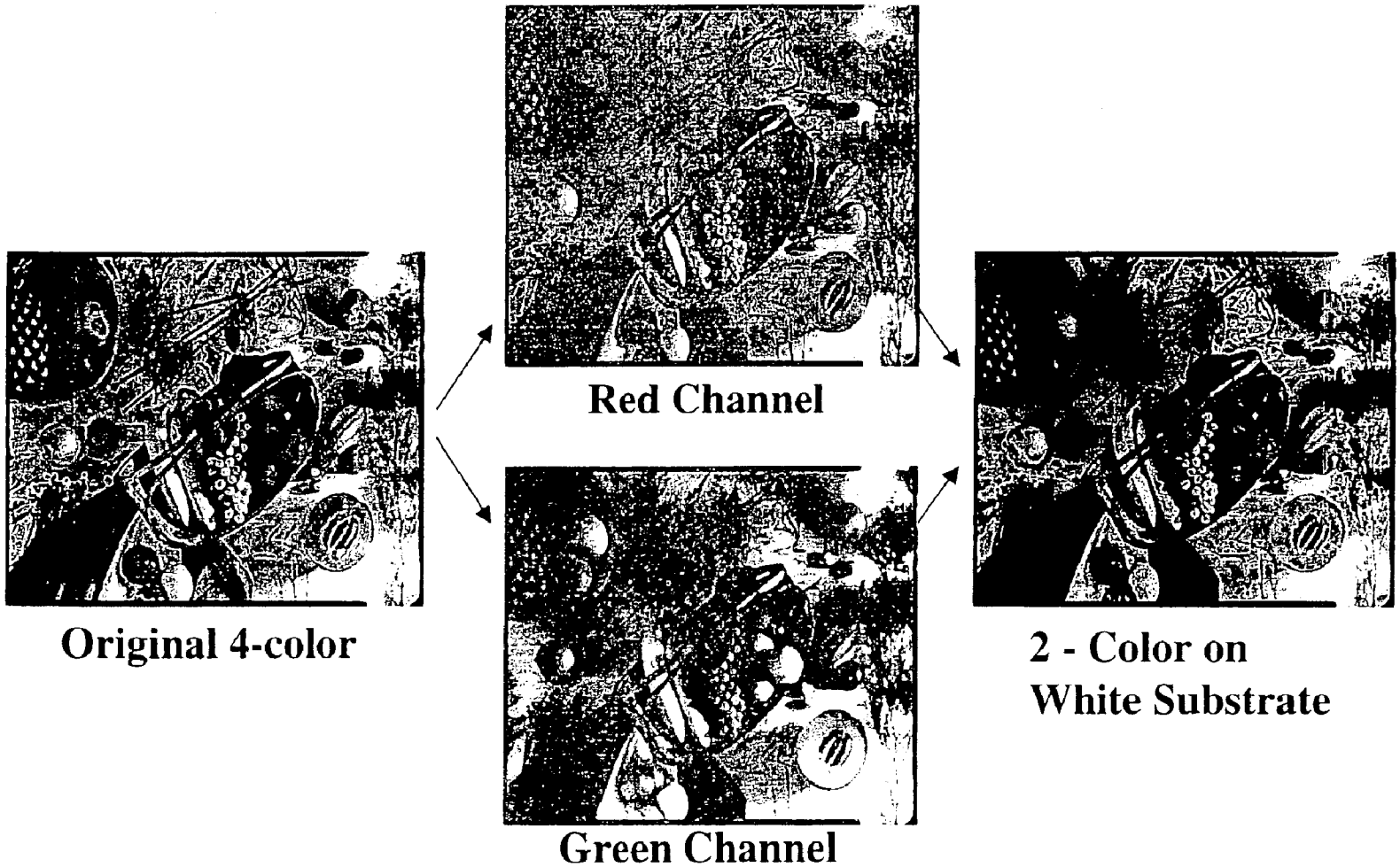
FIG. 2 shows an original four color image, a two color separation, and the resultant image printed on white stock using transparent inks.
Figure 3:
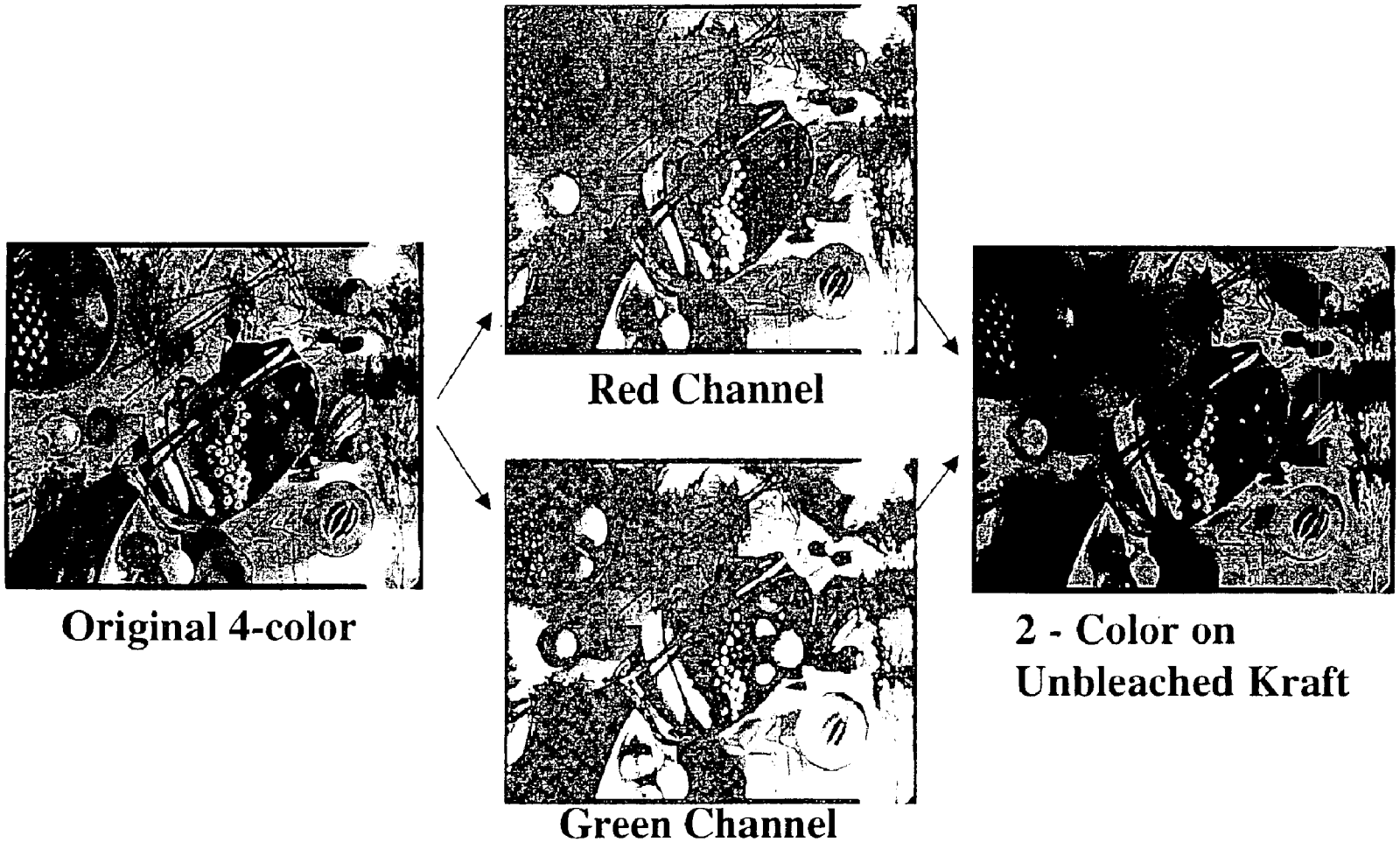
FIG. 3 shows the same four color image, a two color separation, and the resultant image printed on simulated unbleached kraft using transparent inks.
Figure 4:
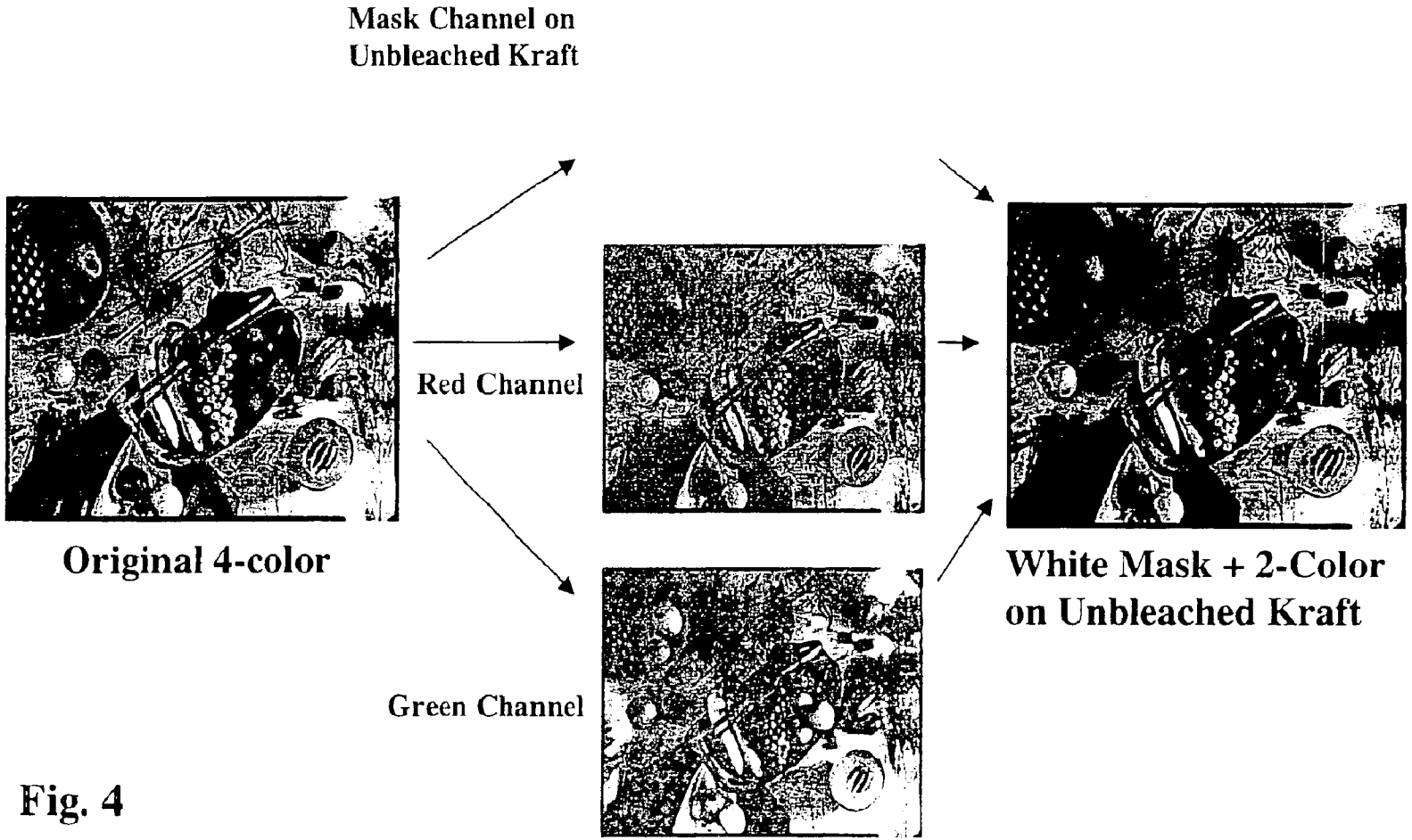
FIG. 4 shows the same four color image, a two color transparent ink separation, and a white masking image, overprinted on simulated unbleached kraft stock.

FIG. 2 shows one embodiment of the present invention An original four color image is seen at the left. Conventional CMYK ink jet technology has been used to reproduce this image. The original image has been processed into two channels, using commercially available software, into optimum separations suitable for dual ink reproduction using selected overprints of transparent red and green inks. The resultant image is seen at the right of the figure as it would appear printed on a white substrate. The right hand image on FIG. 3 shows how the same image might appear if printed on an unbleached kraft paperboard. While entire faithfulness to the original has not been achieved, the right hand image of FIGS. 2 and 3 are remarkable considering that only two inks have been used and the brown color of the substrate on which FIG. 3 is printed. It is notable that neither of the inks used were process primaries.

Where even higher quality is desired on a colored substrate, an opaque ink may be printed first to act as a mask over some or all of the underlying substrate. In this case illustrated in FIG. 4 a white masking ink has been used. It is applied only where lightness is needed and omitted where darkness is needed. The upper image of the central group simulates the white mask as it would appear if printed on an unbleached kraft paper. Below this are seen the same red and green separations used in FIGS. 2 and 3. The resultant overprinted image is seen again at the right on the figure. In this case the technique produces a white point lighter and a black point darker than would be obtained on a standard mottled white stock. The overall effect is a greater dynamic color range and higher contrast ratio. The use of a mask print enables the method to be used on a base substrate of any color and is particularly advantageous where the substrate color can contribute effectively to the appearance of the ultimate image. Similar effects could be achieved by locally applying the opaque ink last. For example, a special spot color, fluorescent ink, varnish, or other ink could be applied over a portion of the transparent ink image.

Color separation and the choice of transparent ink colors can be made using conventional digital image editing computer programs. Examples might be Adobe Photoshop®, available from Adobe Systems, San Jose, Calif., or CorelDRAW®, available from Corel Corp., Ottawa, Ontario. Initial proposed colors may be selected as a first iteration and refinements then made by altering greyscales in each of the other color separations as needed. This can be done to visually match the original image as closely as possible or to obtain another desired result. There is considerable latitude in how the final image might be rendered.

While variations not exemplified herein may suggest themselves to those skilled in the art, it is the intention of the inventors that these should be included within the spirit of the invention if encompassed by the appended claims.

What is claimed is:

1. A method of printing packaging container stock having inner and outer surfaces which comprises printing directly on the outer surface of the stock in color using at least two overprinted transparent inks, of which no more than two of the inks have been selected from the cyan, magenta or yellow process primary colors, and forming the printed container stock into a packaging container, wherein, the container stock has a surface formed from white wood pulp fiber.

2. The method of claim 1 in which at least one opaque ink is used in combination with the transparent inks.

3. The method of claim 2 in which the opaque ink serves as a masking color and is applied to the container stock before or after the transparent inks are applied.

4. The method of claim 1 which comprises using only two transparent inks.

5. The method of claim 1 which comprises using two transparent inks and one opaque ink.

6. The method of claim 5 in which the opaque ink serves as a masking surface.

7. The method of claim 1 in which the packaging container stock is corrugated container board having at least one liner sheet combined with corrugated medium.

8. The method of claim 7 in which one liner sheet of the corrugated container board is printed prior to combining the liner with the corrugated medium.

9. The method of claim 7 in which one liner sheet of the corrugated container board is printed subsequent to combining the liner with the corrugated medium.

10. The method of claim 1 in which the container stock is paperboard.

11. The method of claim 1 in which the packaging container stock is printed by flexography.

12. The method of claim 1 in which the packaging container stock is printed by lithography.

13. A method of printing packaging container stock having inner and outer surfaces which comprises printing directly on the outer surface of the stock in color using at least two overprinted transparent inks, of which no more than two of the inks have been selected from the cyan, magenta or yellow process primary colors, and forming the printed container stock into a packaging container, wherein, the container stock has a surface formed from dyed wood pulp fiber.

14. The method of claim 13 in which at least one opaque ink is used in combination with the transparent inks.

15. The method of 14 in which the opaque ink serves as a masking color and is applied to the container stock before or after the transparent inks are applied.

16. The method of claim 13 which comprises using only two transparent inks.

17. The method of claim 13 which comprises using two transparent inks and one opaque ink.

18. The method of claim 17 in which the opaque ink serves as a masking surface.

19. The method of claim 13 in which the packaging container stock is corrugated container board having at least on sheet combined with corrugated medium.

20. The method of claim 19 in which one liner sheet of the corrugated container board is printed prior to combining the liner with the corrugated medium.

21. The method of claim 19 in which one liner sheet of the corrugated container board is printed subsequent to combining the liner with the corrugated medium.

22. The method of claim 13 in which the container stock is paperboard.

23. The method of claim 13 in which the packaging container stock is printed by flexography.

24. The method of claim 13 in which the packaging container stock is printed by lithography.

* * * * *

UNITED STATES PATENT AND TRADEMARK OFFICE

CERTIFICATE OF CORRECTION

PATENT NO. : 6,854,387 B2
DATED : February 15, 2005
INVENTOR(S) : Lee et al.

It is certified that error appears in the above-identified patent and that said Letters Patent is hereby corrected as shown below:

Column 6,
Line 17, "on sheet combined with corrugated medium" should read -- one liner sheet combined with corrugated medium --.

Signed and Sealed this

Sixth Day of December, 2005

JON W. DUDAS
*Director of the United States Patent and Trademark Office*